US007056177B2

(12) United States Patent
Poldervaart

(10) Patent No.: US 7,056,177 B2
(45) Date of Patent: Jun. 6, 2006

(54) SPREAD MOORED MIDSHIP HYDROCARBON LOADING AND OFFLOADING SYSTEM

(75) Inventor: Leendert Poldervaart, Monte-Carlo (MC)

(73) Assignee: Single Buoy Moorings, Inc., Marly (CH)

( * ) Notice: Subject to any disclaimer, the term of this patent is extended or adjusted under 35 U.S.C. 154(b) by 0 days.

(21) Appl. No.: 10/513,301

(22) PCT Filed: May 5, 2003

(86) PCT No.: PCT/NL03/00329

§ 371 (c)(1),
(2), (4) Date: Jul. 6, 2005

(87) PCT Pub. No.: WO03/093099

PCT Pub. Date: Nov. 13, 2003

(65) Prior Publication Data

US 2005/0257729 A1 Nov. 24, 2005

(51) Int. Cl.
*B63B 22/02* (2006.01)

(52) U.S. Cl. ..... 441/4

(58) Field of Classification Search ..... 441/3–5; 114/230.2, 293; 405/224
See application file for complete search history.

(56) References Cited

U.S. PATENT DOCUMENTS 3,583,354 A 6/1971 Flickinger
3,913,157 A * 10/1975 Versluis et al. ..... 441/5
4,099,542 A * 7/1978 Gibbons ..... 137/615
4,826,354 A * 5/1989 Adorjan ..... 405/158
5,678,503 A * 10/1997 Poranski, Sr. ..... 114/230.2
5,927,224 A * 7/1999 Etheridge et al. ..... 114/230.1
6,170,424 B1 * 1/2001 Boerseth ..... 114/293
6,408,781 B1 * 6/2002 Daniels ..... 114/293
6,494,271 B1 * 12/2002 Wilson ..... 175/5
6,571,723 B1 * 6/2003 Bech et al. ..... 114/230.2
6,692,192 B1 * 2/2004 Poldervaart ..... 405/224

FOREIGN PATENT DOCUMENTS

| | | |
|---|---|---|
| EP | 0 878 388 | 11/1998 |
| GB | 1 363 785 | 8/1974 |
| WO | 97/47516 | 12/1997 |
| WO | 01/10707 | 2/2001 |

* cited by examiner

*Primary Examiner*—Stephen Avila
(74) *Attorney, Agent, or Firm*—Young & Thompson

(57) ABSTRACT

A hydrocarbon mooring and transfer system (2) includes a tower (3) resting on the seabed (4), a vessel (1) containing hydrocarbons, anchoring elements including at least four spaced-apart anchoring members (12, 13, 14, 15) connected via a respective anchor line (21, 22, 23, 25, 26, 27) to the vessel (1), a hydrocarbon transfer duct (6) extending between a coupling position (7), located between the bow (20) and stern (24) of the vessel (1) and the tower (3). The system including at least six anchoring members (12, 13 14, 15, 16, 17, 18, 19), at least four of which are connected to the vessel (1), the vessel being attachable to at least two different groups (12, 13, 14, 15; 14, 16, 17, 18; 15, 16, 18, 19; 12, 13, 17, 19) consisting of four anchoring members in at least two orientations.

12 Claims, 3 Drawing Sheets

SPREAD MOORED MIDSHIP HYDROCARBON LOADING AND OFFLOADING SYSTEM

The invention relates to a hydrocarbon mooring and transfer system comprising a tower resting on the seabed, a vessel containing hydrocarbons, anchoring means comprising at least four spaced-apart anchoring members connected via a respective anchor line to the vessel, a hydrocarbon transfer duct extending between a coupling position, located between the bow and stern of the vessel, and the tower.

Such spread moored hydrocarbon transfer systems are known in the prior art, in particular for oil loading and or offloading to a tower.

Furthermore, from U.S. Pat. No. 4,826,354 an LNG pipeline system is known in which LNG is offloaded from a tanker to an offshore tower resting on the seabed and is transported to shore via a pipeline utilising expansion joints to compensate for contraction. Generally, LNG will be offloaded from the tanker to an onshore storage tank whereas vapour from the storage tank is recirculated to the vessel to keep the tanks under pressure. From the onshore storage, the LNG may be fed to a regasification plant and forwarded to the network.

The known mooring configurations for midship offloading have as a disadvantage that under specific directions of winds and currents, it will not be possible to load or offload at the tower. This could be compensated by providing a rotating transfer duct at the tower having a 360° pipe swivel and dynamic positioning of the tanker vessel around the tower, which is however a costly solution.

An other option to moor an LNG carrier to an LNG offloading terminal comprising a loading crane is via a transfer connection at the stern of the vessel, anchorlines extending to several buoys from the bow and from the stern of the vessel in a spread moored configuration. The anchorlines at the bow of the vessel can be tensioned or slackened in such a way that the vessel can assume different positions depending on wind and current directions by fishtailing around the stern LNG transfer point. This system is described in Offshore Technology Conference 1825, 1973. In this mooring configuration, the transfer duct on the loading and offloading crane must follow the movements of the stern of the vessel, which are relatively large in view of the distance of the stern from the centre of the vessel and the limited fishtailing effect of a moored tanker.

It is therefore an object of the present invention to provide for a loading and offloading system, which can handle tankers having a midship loading and offloading facility.

It is a further object of the present invention to provide for a flexible mooring system in which the vessel can be moored in several orientations depending on wind and current, the transfer duct during loading and/or offloading remaining substantially in a stationary position.

It is again a further object of the present invention to provide for a relatively simple and cost effective mooring system which is particularly suitable for safe and stable loading and offloading of cryogenic fluids, such as LNG or LPG from a vessel to shore.

Hereto, the hydrocarbon mooring transfer system of the present invention is characterised in that the system comprises at least six anchoring members, at least four of which are connected to the vessel, the vessel being attachable to at least two different groups consisting of four anchoring members in at least two orientations.

By providing a number of anchoring points around the tower, each anchoring point comprising for instance one or more piles in combination with a polyester mooring line, one or more pivoting piles or a buoy, the tanker can be spread moored by attaching it to at least four buoys in different orientations, depending on wind and current directions, without it being necessary for the tower to have a fully weathervaning hydrocarbon transfer swivel. Such a selective main orientation of the vessel can guarantee a stable positioning during the time in which the vessel is moored to the tower, which for an offloading operation may be for instance 20 hours for vessel position adjustment, connection of the mooring lines, connection of the hydrocarbon transfer arms, cooling down of the transfer duct, start-up of transfer, finishing and cleaning the transfer duct, disconnection of the transfer arms, mooring lines and take-off of the vessel.

Preferably, a number of eight mooring buoys is used, such that the vessel can be moored in four orientations forming an rectangular pattern around the tower, while loading or offloading from a midship position.

In a preferred embodiment, the vessel comprises a liquefied gas tanker, such as an LNG or LPG tanker. The offloaded LNG storage can be placed on shore but also offshore on a buoy including a regasification plant.

The vessel of the present invention can be a tanker vessel or a combined LNG storage and regasification plant. The vessel can be spread moored in a relatively stiff manner, but can also be provided with weathervaning capacities relative to the tower by employing a spread mooring system such as described in WO 01/10707 and WO 00/78600, in the name of the applicant.

The invention will be described in detail with reference to the accompanying drawing. In the drawing.

Figure 1:
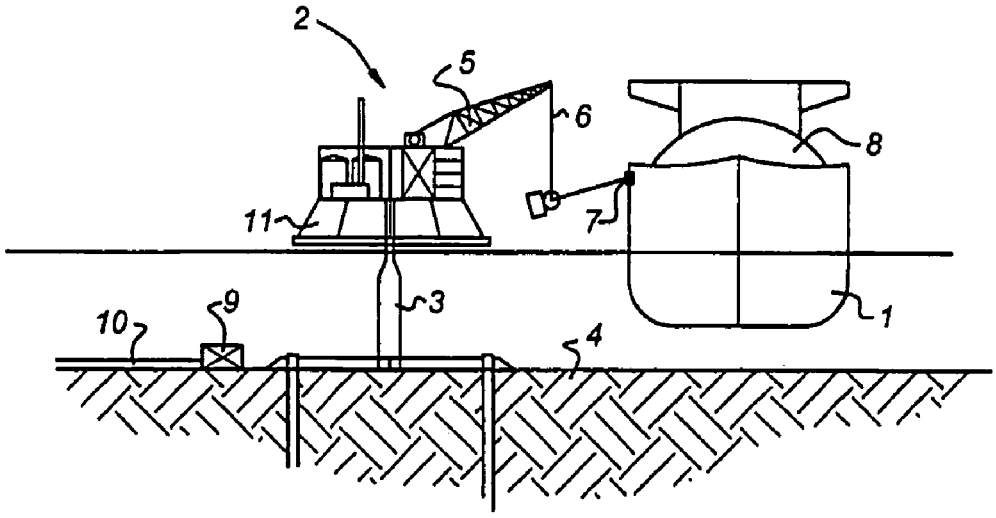
FIG. 1 shows a side view of an LNG offloading system according to the present invention.

FIG. 1 shows an LNG shuttle tanker 1 which is moored in a spread moored configuration alongside an LNG offloading terminal 2 comprising a tower 3 resting on the seabed 4. The tower 3 comprises an arm support structure 5 from which an articulated LNG transfer duct 6 is suspended. The LNG transfer duct 6 can be of the type such as described in WO 99/50173, in the name of the applicant. The cryogenic transfer duct 6 connects to a midship coupling 7 on the tanker vessel 1 for offloading of the tanks 8. Via the tower 3, the LNG is supplied through a manifold 9 to shore through multiple pipelines 10.

The tower 3 is protected by a ring fender 11, which prevents the vessel 1 from contacting the tower 3.

Figure 2:
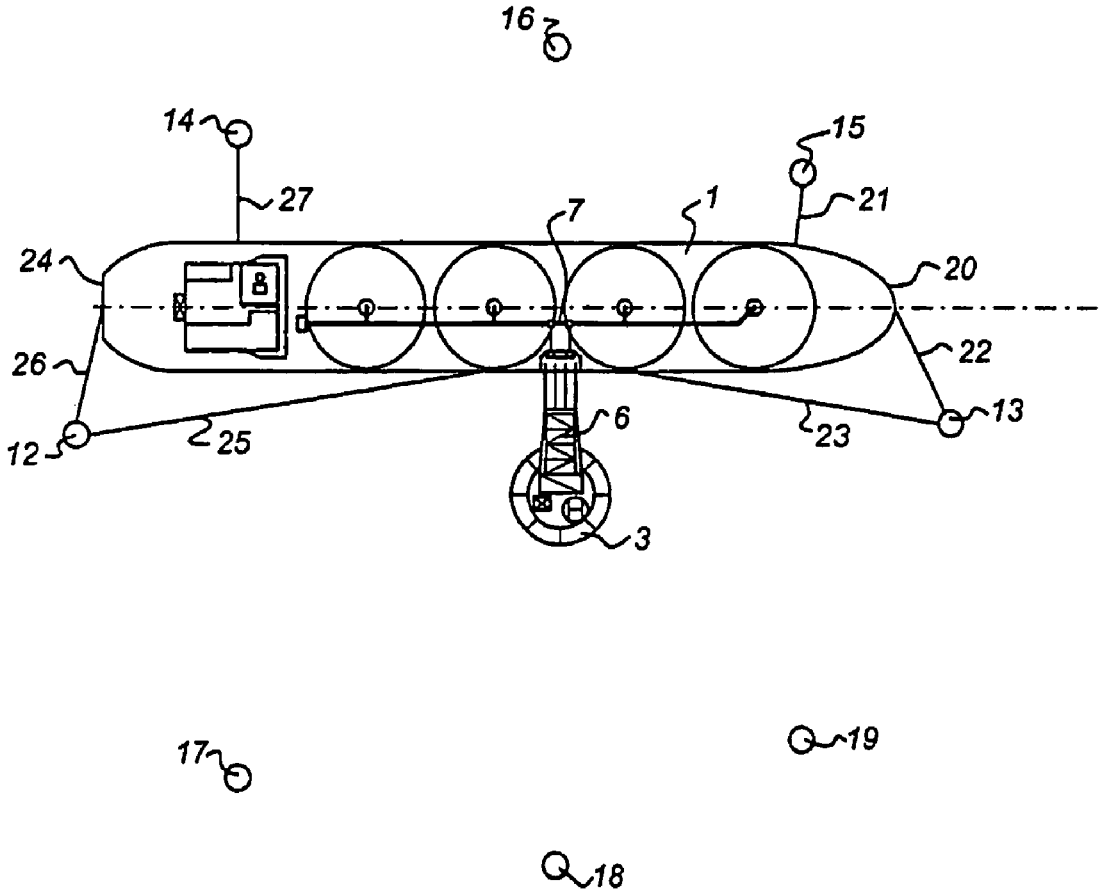
FIG. 2 shows a top view of the mooring and transfer system of FIG. 1.

FIG. 2 shows a top view of the tanker 1, moored to four buoys 12, 13, 14 and 15 and attached to the duct 6 near midship position. The bow 20 of the vessel 1 is attached to buoys 13 and 15 via three anchorlines, including breasting lines, 21, 22 and spring line 23. The stern 24 of the vessel 1 is maintained in a stable and stationary position by being connected to buoys 12 and 14 via three anchorlines, including breasting lines, 26 and 27 and spring line 25. The vessel can be moored in an orientation perpendicular to the one shown in FIG. 2 by connecting anchor lines 23 and 25 to buoy 16 and 18 respectively and anchor lines 21 and 27 to buoys 14 and 17, or by connecting anchor lines 23 and 25 to buoys 18 and 16 respectively and anchor lines 21 and 27 to buoys 19 and 15 respectively. A parallel configuration to the one shown in FIG. 2 is obtained by rotating the shuttle tanker 1 by 180° and connecting anchor lines 21 and 27 to buoys 17 and 19 respectively. In the mooring configuration shown in FIG. 2, there are no buoys in front or in the rear of the vessel such that free access to any of the mooring positions is warranted.

The tower 3 is provided with a rotating deck and manifold for rotation of the duct 6, which may be a plus or minus 180° rotation from the position shown in FIG. 2, but which need not be a fully 360° rotating arm.

Figure 3:
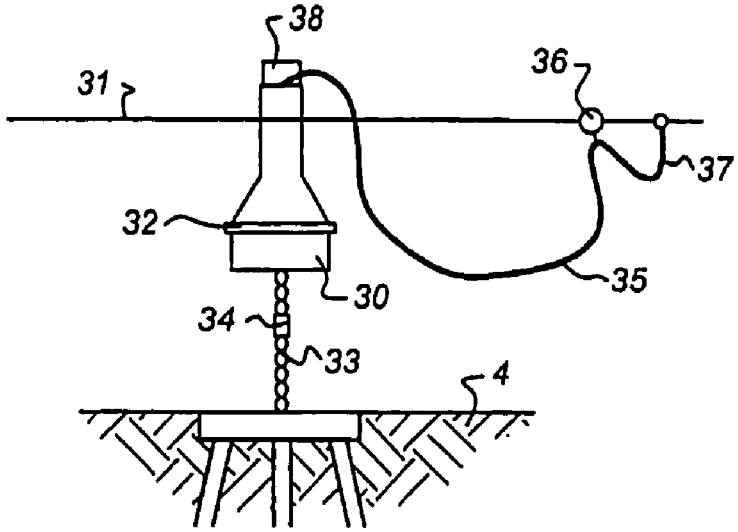
FIG. 3 shows an example of an anchoring buoy used in the mooring and transfer system of the present invention.

As is shown in FIG. 3, the buoys used are submerged anchorline buoys (SALM) 30 which float at sealevel 31 and which comprise a fender 32 for protecting the buoys against damage when impacting with a shuttle tanker 1 or tug installing the tanker in its mooring position. The buoy 30 is connected to the seabed through a chain 33, which comprises a chain swivel 34. The slender upper part of the buoy may have a diameter of 2 meters, whereas the broadened liner part may have a diameter of about 6 meters. A mooring hawser 35 is connected to the top of the buoy and comprises a floatation device 36 and pick-up line 37 for connecting it to the tanker 1. For the buoys 16, 17, 18 and 19 shown in FIG. 2 which are not connected to the vessel, the mooring hawser 35 will not be attached. Only the buoys that are used in the mooring configuration will be provided with mooring hawsers 35 when the vessel approaches the terminal. This prevents accidents with the mooring lines and reduces the risk of mooring lines entering in the propellers and will give the tugs more freedom of motion at the terminal for positioning of the tanker vessel. Hereto, a connector 38 is provided at the mooring line 35 for releasably engaging with the buoy 30. Alternatively, the mooring hawsers 35 of the buoys, which are not connected to the vessel in a particular anchoring configuration, are rolled up and connected on the respective buoy such that they do not freely float in the water.

Figure 4:
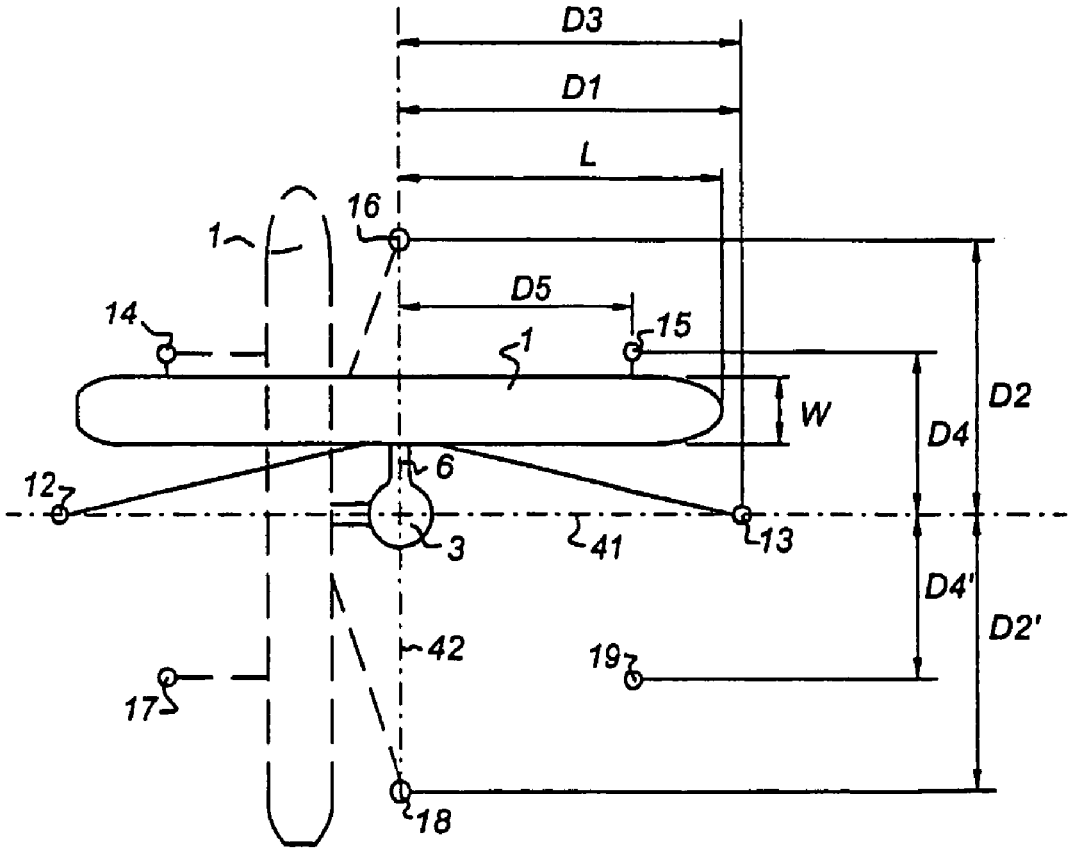
FIGS. 4 and 5 show different mooring configurations obtainable with the present system.

FIG. 4 shows two positions of the vessel 1 alongside the tower 3. With respect to a first axis 41 and second axis 42, that are perpendicular and intersect at the tower 3, the buoys 12 and 13 are located at or near the first axis 41. The distance 2D1 between buoys 12 and 13 may be 1–1.5 times the length 2L of the vessel 1. The buoys 14 and 15 may be located at a distance D4 from axis 41 which is larger than the width of the vessel W and combined width of tower 3 and transfer duct 6. Distance D4 may be for instance 30 meters. Distance D5 of buoy 15 from axis 42 may be for instance 100 meters. The length of the vessel 1 is for instance 250 meters. Buoys 17, 18 and 19 are symmetrical with buoys 14, 15, 16 around the axis 41 and have corresponding distances D1 and D4 from the axis 41.

Figure 5:
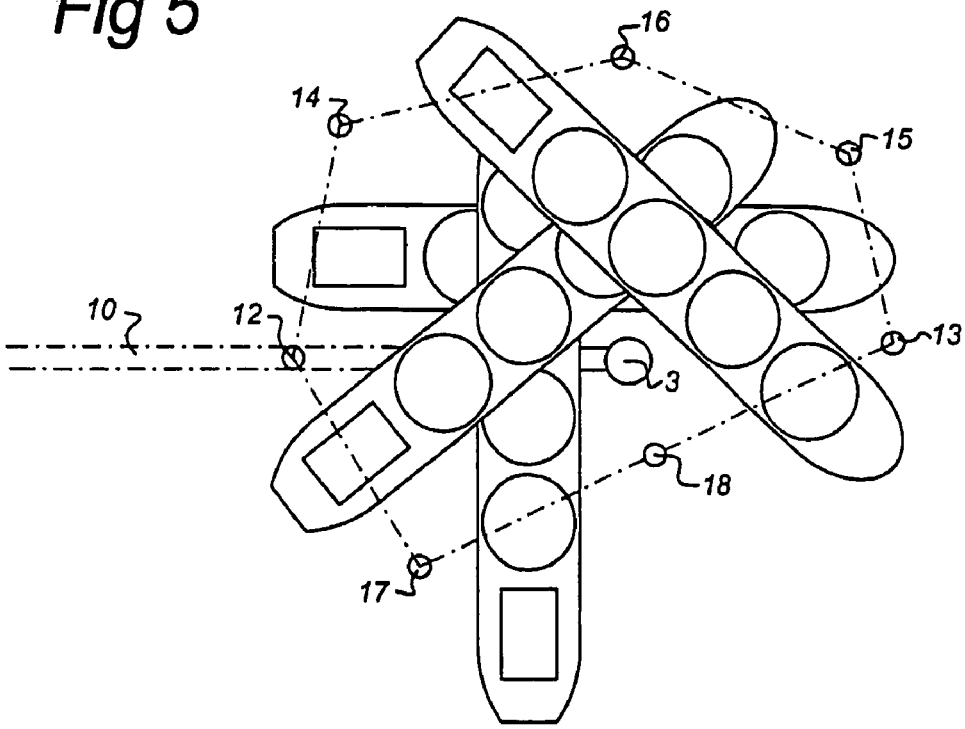

FIG. 5 shows possible mooring configurations around a tower 3 by using only seven buoys, allowing for different mooring positions. The number of mooring buoys in excess of four depends on the required number of positional variations and consequently on prevailing wind and weather conditions in this specific area of operation.

Figure 6:
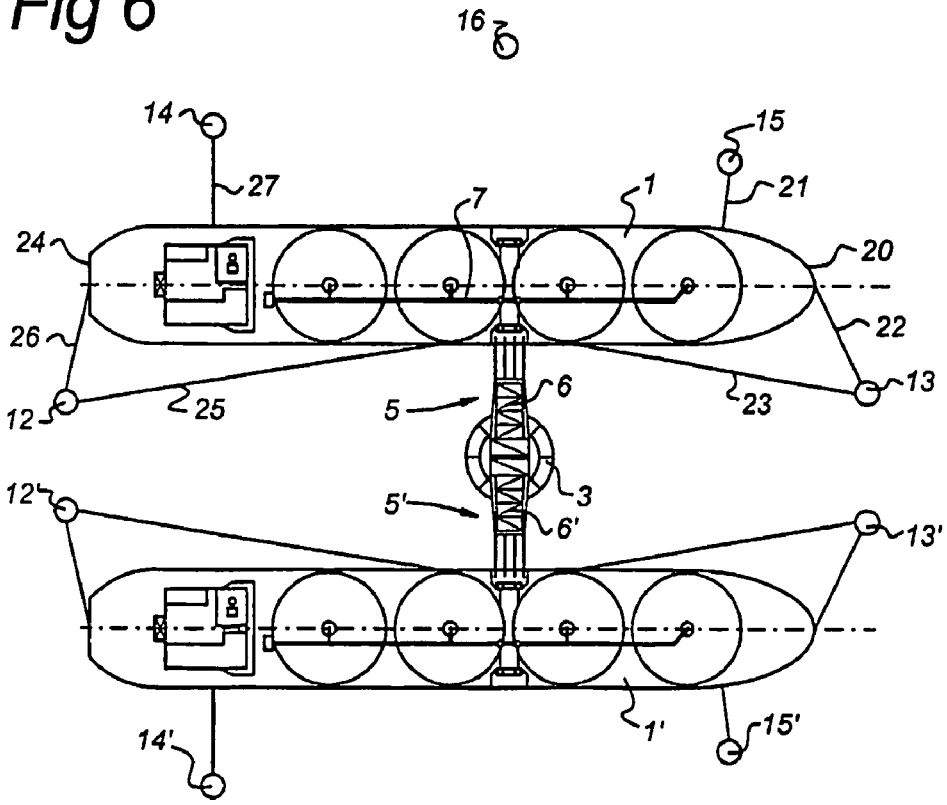
FIG. 6 shows an embodiment of an offloading system for continuous offloading.

Finally, FIG. 6 shows a mooring configuration in which the tower 3 comprises two support structures 5, 5' with each a cryogenic fluid transfer duct 6, 6'. Two sets of four buoys 12, 13, 14, 15 and 12', 14', 15', 16', are used for mooring of two tankers 1, 1', each attached to a respective transfer duct 6, 6'. When one tanker 1 is nearly emptied, offloading of the second tanker 1' can start via duct 6', such that a continuous and uninterrupted supply of gas to shore is warranted.

The invention claimed is:

1. Hydrocarbon mooring and transfer system (2) comprising a hydrocarbon transfer station (3) and a vessel (1) containing hydrocarbons, anchoring means comprising at least six spaced-apart anchoring members (12, 13, 14, 15, 16, 17, 18, 19) at least four of which are connected via a respective anchor line (21, 22, 23, 25, 26, 27) to the vessel (1), a hydrocarbon transfer duct (6) extending between a coupling position (7) located between the bow (20) and the stern (24) and the hydrocarbon transfer station (3), characterised in that, the hydrocarbon transfer station (3) comprises a tower resting on the seabed, the hydrocarbon transfer duct (6) being movable with respect to the tower (3) between different angular positions on the tower (3), the anchoring members (12–19) being arranged with respect to the tower (3) in such a manner that the vessel is attachable in at least two mutually transverse orientations, the vessel in a first orientation being attached to a first group of at least four anchoring members (12, 13, 14, 15) and in the second orientation being attached to a second group at least four anchoring members (14, 16, 17, 18; 15, 16, 18, 19; 12, 13, 17, 19), which second group is different from said first group, the transfer duct (6) in each orientation extending between the coupling position (7) and the tower (3).

2. Hydrocarbon mooring and transfer system (2) according to claim 1, wherein, when considering a first (41) and second axis (42), the axes being perpendicular and having a point of intersection at or near the tower (3), a first and second buoy (12, 13) are located on or near the first axis (41) at a mutual distance (2D1) corresponding to at least two/third of the length (2L) of the vessel (1) on respective sides of the second axis (42), a third and fourth buoys (14, 15) being placed at a mutual distance (2D5) corresponding to at least one/third of the length (L) of the vessel (1) on respective sides of the second axis (42), at a perpendicular distance (D4) from the first axis (41) that is larger than the combined width (W) of the vessel and length of the duct (6), a fifth buoy (16) being placed on or near the second axis (42) on the same side of the first axis (41) as the third and fourth buoys (14, 15), further away from the first axis (41) than the third and fourth buoy (14, 15), and a sixth buoy (17) being placed on a side of the first axis (41) opposite to the side of the third and fourth buoys (14, 15) at a perpendicular distance (D4') from the first axis (41) that is larger than the combined width (W) of the vessel and length of the duct (6), the position of the sixth buoy (17) along the first axis (41) being located between the tower (3) and the first buoy (12).

3. Hydrocarbon mooring and transfer system (2) according to claim 1, wherein a seventh buoy (18) is located at or near the second axis (42), on the side of the first axis (41) opposite to the side of the third and fourth buoys (14, 15), at a position (D2') further away from the first axis (41) than the sixth buoy (17), and an eighth buoy (19), located on the side of the first axis (41) opposite to the third and fourth buoys (14, 15), the position of eighth buoy (19) along the first axis (41) being located between the seventh and the second buoys (18, 13).

4. Hydrocarbon mooring and transfer system (2) according to claim 1, wherein the distance (2D1) between the first and second buoys (12, 13) along the first axis (41) is larger than the length (2L) of the vessel, the distance (2D5) between the third and fourth buoys (14, 15) along the first axis (41) being smaller than the length (2L) of the vessel, the distance (2D5) between the sixth and eighth buoys (17, 19) along the first axis (41) substantially corresponding to the distance (2D5) between the third and fourth buoys (14, 15), the distance (2D2) between the fifth and seventh buoys (16,

18) along the second axis (42) substantially corresponding to the distance (2D1) between the first and second buoys (12, 13) along the first axis (41).

5. Hydrocarbon mooring and transfer system (2) according to claim 1, wherein the vessel (1) comprises a liquefied gas tanker, the transfer duct (6) comprising a cryogenic transfer duct.

6. Hydrocarbon mooring and transfer system (2) according to claim 1, the transfer duct (6) being connected to the tower (3) via a support structure (51) that is rotatable around a vertical axis by less than 360 degrees.

7. Hydrocarbon mooring and transfer system (2) according to claim 1, each anchoring member comprising a buoy (30).

8. Hydrocarbon mooring and transfer system (2) according to claim 1, the anchoring member (12, 13, 14, 15, 16, 17, 18, 19) having a detachable anchor line connector (35, 36, 37, 38).

9. Hydrocarbon mooring and transfer system (2) according to claim 8, the anchorline connector comprising an anchorline (35) attached to the buoy (30) having a floatation (36) at one free end, the buoy (30) being placed at or near the sea surface, wherein the buoys in the system that are not attached to the vessel having no anchorline attached thereto.

10. Hydrocarbon mooring and transfer system (2) according to claim 1, the vessel (1) being attached to the buoys in a non-rigid manner to be able to weathervane through small angles.

11. Hydro carbon mooring and transfer system (2) according to claim 1, comprising a tower (3) having two transfer ducts (6).

12. Hydrocarbon mooring and transfer system (2) according to claim 11, wherein the transfer ducts extend in substantially diametrically opposed directions from the tower (3).

* * * * *